US008734958B2

(12) United States Patent
Ohta et al.

(10) Patent No.: US 8,734,958 B2
(45) Date of Patent: May 27, 2014

(54) MATERIAL FOR FORMING ELECTROLESS PLATE, COATING SOLUTION FOR ADHERING CATALYST, METHOD FOR FORMING ELECTROLESS PLATE, AND PLATING METHOD

(75) Inventors: Tetsuji Ohta, Tokyo (JP); Keiko Kitamura, Saitama (JP); Mitsuhiro Watanabe, Yokosuka (JP)

(73) Assignees: Kimoto Co., Ltd., Saitama (JP); Kanto Gakuin University Surface Engineering Research Institute, Kanagawa (JP)

( * ) Notice: Subject to any disclaimer, the term of this patent is extended or adjusted under 35 U.S.C. 154(b) by 1174 days.

(21) Appl. No.: 12/525,469

(22) PCT Filed: Feb. 1, 2008

(86) PCT No.: PCT/JP2008/051637

§ 371 (c)(1),
(2), (4) Date: Jul. 31, 2009

(87) PCT Pub. No.: WO2008/096671

PCT Pub. Date: Aug. 14, 2008

(65) Prior Publication Data

US 2011/0005936 A1 Jan. 13, 2011

(30) Foreign Application Priority Data

Feb. 7, 2007 (JP) ..... 2007-027555

(51) Int. Cl.

| | |
|---|---|
| ***B32B 5/00*** | (2006.01) |
| ***B32B 5/16*** | (2006.01) |
| ***B32B 15/04*** | (2006.01) |
| ***B32B 15/08*** | (2006.01) |
| ***B32B 15/09*** | (2006.01) |
| ***B32B 27/14*** | (2006.01) |
| ***B32B 27/36*** | (2006.01) |

(52) U.S. Cl.
USPC ..... 428/458; 428/457; 428/480

(58) Field of Classification Search
None
See application file for complete search history.

(56) References Cited

U.S. PATENT DOCUMENTS

| | | | | | |
|---|---|---|---|---|---|
| 3,011,920 | A | * | 12/1961 | Shipley, Jr. | 106/1.11 |
| 3,532,518 | A | * | 10/1970 | Ottavio | 106/1.11 |
| 3,790,400 | A | * | 2/1974 | Kuzmik | 428/328 |
| 3,932,356 | A | * | 1/1976 | Takagi | 522/21 |
| 3,958,048 | A | * | 5/1976 | Donovan et al. | 427/304 |
| 4,301,190 | A | * | 11/1981 | Feldstein | 216/13 |
| 4,394,442 | A | * | 7/1983 | Miller | 430/532 |
| 4,476,189 | A | * | 10/1984 | Posey et al. | 428/336 |
| 4,493,872 | A | * | 1/1985 | Funderburk et al. | 428/332 |
| 4,525,419 | A | * | 6/1985 | Posey et al. | 428/336 |
| 4,845,189 | A | * | 7/1989 | Rudd et al. | 528/272 |
| 4,880,700 | A | * | 11/1989 | Charmot et al. | 428/337 |
| 4,971,863 | A | * | 11/1990 | Hart | 428/458 |
| 5,070,179 | A | * | 12/1991 | Kim et al. | 528/272 |
| 5,082,734 | A | * | 1/1992 | Vaughn | 428/411.1 |
| 5,275,861 | A | * | 1/1994 | Vaughn | 428/76 |
| 5,306,606 | A | * | 4/1994 | Tachibana et al. | 430/533 |
| 5,356,989 | A | * | 10/1994 | Tachika et al. | 524/608 |
| 5,380,590 | A | * | 1/1995 | Nakamura et al. | 428/375 |
| 5,721,023 | A | * | 2/1998 | Ostapchenko | 428/35.2 |
| 5,811,197 | A | * | 9/1998 | Nishiyama et al. | 428/480 |
| 5,985,437 | A | * | 11/1999 | Chappell et al. | 428/336 |
| 6,114,439 | A | * | 9/2000 | Hwu et al. | 524/845 |
| 6,306,956 | B1 | * | 10/2001 | Spilman et al. | 524/601 |
| 6,562,899 | B2 | * | 5/2003 | Buter et al. | 524/591 |
| 7,179,873 | B2 | * | 2/2007 | Reimers et al. | 526/240 |
| 7,427,435 | B2 | * | 9/2008 | Posey | 428/195.1 |
| 7,700,187 | B2 | * | 4/2010 | Konrad et al. | 428/336 |
| 2006/0056684 | A1 | | 3/2006 | Kurane | 382/162 |

FOREIGN PATENT DOCUMENTS

| | | | |
|---|---|---|---|
| GB | 2169925 | * | 7/1986 |
| JP | 03-064481 | | 3/1991 |
| JP | 06-107832 | | 4/1994 |
| JP | 2002-105231 | | 4/2002 |
| JP | 2002-220677 | | 8/2002 |

OTHER PUBLICATIONS

Pesresin A Series Properties, retrieved from http://www.takamatsuyusi.co.jp/toppage-e/pesresin.htm on Mar. 12, 2012.*

* cited by examiner

*Primary Examiner* — Vivian Chen

(74) *Attorney, Agent, or Firm* — Bacon & Thomas, PLLC

(57) ABSTRACT

A material for forming electroless plate shows favorable catalyst adhering property, and shows no delamination of catalyst adhering layer from non-conductive base material, no dissolution of catalyst adhering layer into a plating solution, and no discoloration of interface of plate layer with catalyst adhering layer during the catalyst adhering step, development step and other steps. The material includes a non-conductive base material and a catalyst adhering layer, provided on the non-conductive base and including a water-insoluble polyester resin The catalyst adhering layer shows a contact angle of 60° or smaller to purified water.

4 Claims, No Drawings

MATERIAL FOR FORMING ELECTROLESS PLATE, COATING SOLUTION FOR ADHERING CATALYST, METHOD FOR FORMING ELECTROLESS PLATE, AND PLATING METHOD

TECHNICAL FIELD

The present invention relates to a material for forming electroless plate, which is formed by subjecting a non-conductive base material to a treatment enabling electroless plating.

BACKGROUND ART

Electroless plating is widely used as an industrial technique which can change non-conductive base material surfaces such as those of plastics, ceramics, paper, glass, and fibers into conductive surfaces. Especially when a surface of non-conductive base material is to be electrolytically plated, the non-conductive base material is electrolessly plated as a pretreatment for the electrolytic plating.

However, it is difficult to form electroless plate directly on a surface of non-conductive base material. This is because it is difficult to adhere a catalyst layer as a pretreatment for electroless plating to a base material surface, since the non-conductive base material has a smooth surface.

Therefore, surface of the non-conductive base material is conventionally roughened by a mechanical treatment or chemical treatment to enable adhesion of a catalyst to the base material surface. However, if surface of the base material is roughened, the material as a whole becomes opaque, and therefore there arises a problem that the material becomes unsuitable for use requiring transparency.

As means for solving this problem, there has been proposed a means for forming a gelatinous thin membrane containing a water-soluble polymer (catalyst adhering layer) on a non-conductive base material (Patent document 1).

Patent document 1: Japanese Patent Unexamined Publication (KOKAI) No. 2002-220677 (claims)

DISCLOSURE OF THE INVENTION

Object to be Achieved by the Invention

However, in the method of Patent document 1, although the gelatinous thin membrane adheres the catalyst, the gelatinous thin membrane may be delaminated or dissolved from the non-conductive base material, when the gelatinous thin membrane is immersed in a catalyst bath in the catalyst adhering step or when a developer is brought into contact with the gelatinous thin membrane in the development step after the electrolytic plating.

As means for solving this problem, it is conceivable to use a means of curing the gelatinous thin membrane to improve durability thereof to solvents used for the catalyst bath or developer. However, if the gelatinous thin membrane is cured, adhesion between the gelatinous thin membrane and the non-conductive base material is degraded, and thus the phenomenon of delamination of the gelatinous thin membrane from the non-conductive base material in the catalyst adhering step, development step and other steps cannot be sufficiently prevented.

As means for solving the aforementioned problem, the inventors of the present invention developed a material for forming electroless plate comprising a non-conductive base material as well as a curable layer formed from a resin having hydroxyl group and an isocyanate type compound and a catalyst adhering layer formed from a hydrophilic and/or water-soluble resin containing hydroxyl group, which are provided on the non-conductive base material (Japanese Patent Application No. 2006-80942, WO2007/108351).

However, although the material for forming electroless plate of Japanese Patent Application No. 2006-80942 solves the aforementioned problem, it has a drawback that interface of the plate layer with the catalyst adhering layer blackly discolors. This discoloration is conspicuous especially when the non-conductive base material is transparent, and the material is observed from the base material side.

Therefore, an object of the present invention is to provide a material for forming electroless plate which does not show delamination of a catalyst adhering layer from a non-conductive base material or dissolution of the same into a plating solution, and no discoloration of the interface of the plate layer with the catalyst adhering layer in a catalyst adhering step, development step and other steps.

Means for Achieving the Object

The material for forming electroless plate of the present invention, with which the aforementioned object is achieved, is a material for forming electroless plate comprising a non-conductive base material and a catalyst adhering layer provided on the non-conductive base material, wherein the catalyst adhering layer comprises a water-insoluble polyester resin, and surface of the catalyst adhering layer shows a contact angle of 60° or smaller to purified water.

In the material for forming electroless plate of the present invention, the water-insoluble polyester resin is preferably a self-crosslinkable polyester resin.

In the material for forming electroless plate of the present invention, the catalyst adhering layer preferably contains the polyester resin in an amount of 50% by weight or more of the total resin constituting the catalyst adhering layer.

The coating solution for adhering catalyst of the present invention is a coating solution for adhering catalyst for adhering a catalyst for electroless plating to a non-conductive base material, which comprises a water-insoluble polyester resin introduced with hydrophilic groups so that surface of coating formed from the coating solution should show a contact angle of 60° or smaller to purified water.

In the coating solution for adhering catalyst of the present invention, the water-insoluble polyester resin is preferably a self-crosslinkable polyester resin.

The method for forming an electroless plate of the present invention comprises adhering a catalyst to the catalyst adhering layer of the material for forming electroless plate of the present invention, and then performing electroless plating.

The plating method of the present invention comprises a step (1) of adhering a catalyst to a catalyst adhering layer of a material for forming electroless plate comprising a non-conductive base material and the catalyst adhering layer provided on the non-conductive base material, a step (2) of immersing the material for forming electroless plate adhered with the catalyst in an electroless plating solution containing a compound of a metal to be plated and performing electroless plating, and a step (3) of immersing the material for forming electroless plate on which electroless plate is formed in an electrolytic plating bath and performing electrolytic plating by electrifying it, wherein the material for forming electroless plate of the present invention is used as the material for forming electroless plate.

The plating method of the present invention comprises a step (1) of adhering a catalyst to a catalyst adhering layer of a material for forming electroless plate comprising a non-conductive base material and the catalyst adhering layer provided on the non-conductive base material, a step (2) of immersing the material for forming electroless plate adhered with the catalyst in an electroless plating solution containing a compound of a metal to be plated and performing electroless plating, and a step (3) of immersing the material for forming electroless plate on which electroless plate is formed in an electrolytic plating bath and performing electrolytic plating by electrifying it, wherein a material for forming electroless plate in which a catalyst adhering layer is formed by applying the coating solution for adhering catalyst of the present invention on a surface of a non-conductive base material is used as the material for forming electroless plate.

The plating method of the present invention preferably comprises a step (4) of heating the material for forming electroless plate to advance crosslinking of the polyester resin. The step (4) is preferably performed after the step (1) and before the step (3).

Effect of the Invention

In the material for forming electroless plate of the present invention, the catalyst adhering layer comprises a water-insoluble polyester resin, and surface of the catalyst adhering layer shows a contact angle of 60° or smaller to purified water. Therefore, it shows favorable catalyst adhering performance, does not show delamination of the catalyst adhering layer from the non-conductive base material or dissolution of the same into a plating solution, and shows no discoloration of the plate layer.

Moreover, according to the method for forming electroless plate of the present invention, an electroless plate can easily be formed on a non-conductive base material in a short period of time, and the catalyst adhering layer on the non-conductive base material does not delaminate during the operation.

BEST MODE FOR CARRYING OUT THE INVENTION

Hereafter, embodiments of the material for forming electroless plate of the present invention will be explained. The material for forming electroless plate of the present invention comprises a non-conductive base material and a catalyst adhering layer formed on the non-conductive base material.

Examples of the non-conductive base material include plastic films such as those of polyester, ABS (acrylonitrile/butadiene/styrene), polystyrene, polycarbonate, acrylic resin, liquid crystal polymer (LCP), polyolefin, cellulose resin, polysulfone, polyphenylene sulfide, polyethersulfone, polyetheretherketone and polyimide, those made of glass, ceramics, paper, fibers, and so forth. Among these, transparent base materials such as those made of plastics and glass can be preferably used, since such transparent base materials enable observation of favorable metallic luster from the non-conductive base material side after formation of plate. The non-conductive base material is not limited to those having a flat shape, and it may have a three-dimensional shape.

The non-conductive base material may be one subjected to an adhesion promoting treatment for enhancing adhesion to the catalyst adhering layer. Examples of the adhesion promoting treatment include corona discharge treatments and plasma treatments.

When the non-conductive base material may be opaque, a base material having a roughened surface may also be used. If the surface of the base material is roughened, the surface of the catalyst adhering layer can be roughened by the surface roughness of the base material, and adhesion of the catalyst can be thereby made easier.

The catalyst adhering layer plays a role of adhering fine metal particles having a catalytic activity for electroless plating (catalyst). In the present invention, a layer comprising a water-insoluble polyester resin, of which surface shows a contact angle of 60° or smaller to purified water, is used as such a catalyst adhering layer.

If a polyester resin is used for the catalyst adhering layer, catalyst adhering property and blackening of plate are improved to a certain extent. However, when the polyester resin is water-soluble, it is likely to dissolve in a plating solution or a catalyst solution. In the present invention, by using a water-insoluble polyester resin as the polyester resin, dissolution of the catalyst adhering layer in a plating solution or a catalyst solution can be prevented to prolong life of the plating solution or catalyst solution, and delamination of the catalyst adhering layer can be prevented. Catalyst adhering property of water-insoluble resin is generally inferior to that of water-soluble resin. However, in the present invention, contact angle of the catalyst adhering layer surface to purified water is made to be 60° or smaller to give hydrophilicity, and thereby favorable catalyst adhering property can be obtained even with use of a water-insoluble resin. Further, a water-insoluble polyester resin can prevent blackening of plating better compared with a water-soluble polyester resin.

The contact angle of the catalyst adhering layer surface to purified water is more preferably 55° or smaller in order to obtain more favorable catalyst adhering property.

The polyester resin is produced by condensing a polybasic carboxylic acid and a polyhydric alcohol as essential components.

Examples of the polybasic carboxylic acid include dibasic acids or polybasic acids of higher basicity, such as phthalic acid, terephthalic acid, isophthalic acid, trimellitic acid, trimesic acid, pyromellitic acid and biphenyl-tetracarboxylic acid, anhydrides thereof, and so forth.

Generally used as the polyhydric alcohol is a dihydric alcohol such as ethylene glycol, propylene glycol, 1,3-propanediol, 1,4-butanediol, 1,5-pentanediol, 1,6-hexanediol, 2,2-diethyl-1,3-propanediol, neopentyl glycol, 1,9-nonanediol, 1,4-cyclohexanedimethanol, hydroxypivalic acid neopentyl glycol ester, 2-butyl-2-ethyl-1,3-propanediol, 3-methyl-1,5-pentanediol, 2,2,4-trimethylpentanediol and hydrogenated bisphenol A.

As means for obtaining a contact angle of the catalyst adhering layer surface to purified water of 60° or smaller with use of a water-insoluble polyester resin, it is conceivable (1) to add a resin showing superior catalyst adhering property to the polyester resin, or (2) to adjust hydrophilicity of the water-insoluble polyester resin itself. In the present invention, the latter means is adopted. Hydrophilicity of the water-insoluble polyester resin can be controlled by suitably selecting types of the aforementioned polybasic carboxylic acid and polyhydric alcohol, suitably adjusting hydroxyl value of the polyester resin, denaturing the polyester resin, or the like.

When hydroxyl value of the polyester resin is adjusted, hydroxyl value is preferably adjusted to be not lower than 10 mg KOH/g and not higher than 400 mg KOH/g.

With a hydroxyl value of the polyester resin of 10 mg KOH/g or higher, it becomes easy to make the contact angle of the catalyst adhering layer surface to purified water 60° or smaller, and catalyst adhering property can be made favorable. With a hydroxyl value of the polyester resin of 400 mg KOH/g or lower, the polyester resin can be made to be water-insoluble, thereby dissolution preventing property of the catalyst adhering layer can be made favorable, thus life of plating solution or catalyst solution can be prolonged, delamination of the catalyst adhering layer can be prevented, and blackening of plate can be more favorably prevented.

Hydroxyl value of the polyester resin can be adjusted by using, besides the dihydric alcohol mentioned above, for example, a trihydric alcohol or an alcohol of further higher hydricity, or a polyhydric alcohol containing a diepoxy compound moiety. Namely, by replacing a part of the dihydric alcohol having a hydroxyl value corresponding to the acid value of the dicarboxylic acid used as the carboxylic acid component with a trihydric alcohol or an alcohol of further higher hydricity, or by using an epoxy compound in addition to such an alcohol as mentioned above, hydroxyl groups can be introduced into the polyester resin, and hydroxyl value of the polyester resin can be adjusted by adjusting amount of the polyhydric alcohols other than dihydric alcohol, such as a trihydric alcohol or alcohol of higher hydricity and a polyhydric alcohol containing diepoxy compound moiety.

Examples of the trihydric alcohol and alcohol of further higher hydricity include trimethylolethane, trimethylolpropane, glycerol, pentaerythritol, dipentaerythritol, sorbitol, glucose, mannitol, sucrose, glucose, and so forth.

Examples of the polyhydric alcohol containing a diepoxy compound moiety include glycidyl ether of bisphenol A, glycidyl ether of bisphenol F, dimer acid glycidyl esters, aliphatic acid glycidyl ethers, and so forth.

When the polyester resin is denatured, a polyester resin having a polymerizable unsaturated double bond and monomers having a polymerizable unsaturated double bond are graft-copolymerized to introduce hydrophilic groups into either the polyester resin serving as a backbone or the monomers serving as branch moieties. Although hydrophilic groups may be introduced into either the polyester resin serving as a backbone or the monomers serving as branch moieties, it is preferable to obtain hydrophilicity with the branch moieties, not the backbone serving as the basic structure, since it makes easier to simultaneously obtain improvement of hydrophilicity for improving catalyst adhering property, and the incompatible performance, prevention of dissolution of the catalyst adhering layer. As for ratio of the backbone and branch moieties, ratio of parts having hydrophilic groups and parts not having hydrophilic groups is preferably 2:8 to 8:2.

The polyester resin having a polymerizable unsaturated double bond is obtained by introducing unsaturated groups into the polyester resin as maleic acid, maleic anhydride, itaconic acid, fumaric acid, crotonic acid, tetrahydrophthalic acid or the like.

The monomers having a polymerizable unsaturated double bond include various monomers. Those having a hydrophilic group and those having a hydrophobic group are explained below.

As the monomers having a polymerizable unsaturated double bond and a hydrophilic group, monomers having a polymerizable double bond and a hydrophilic group such as carboxyl group, hydroxyl group, hydroxymethyl group, amino group, sulfonic acid group, a polyethylene oxide group, a sulfuric acid ester salt group and a phosphoric acid ester salt group can be used. Examples of such monomers include, for example, (meth)acrylates having hydroxyl group such as 2-hydroxylethyl(meth)acrylate and 2-hydroxypropyl (meth)acrylate, ethylenically unsaturated carboxylic acids such as acrylic acid and methacrylic acid containing carboxyl group, maleic acid or a monoalkyl ester thereof, itaconic acid or a monoalkyl ester thereof, and fumaric acid or a monoalkyl ester thereof, meth)acrylamides such as acrylamide, N-methylol(meth)acrylamide and N,N-dimethylacrylamide, alkylamino esters of acrylic acid or methacrylic acid such as N-methylaminoethyl methacrylate, N-methylaminoethyl acrylate, dimethylaminoethyl methacrylate, dimethylaminoethyl acrylate, diethylaminoethyl methacrylate and diethylaminoethyl acrylate, unsaturated amides having an alkylamino group such as N-(2-dimethylaminoethyl)acrylamide, N-(2-dimethylaminoethyl)methacrylamide and N,N-dimethylaminopropylacrylamide; monovinylpyridines such as vinylpyridine; vinyl ethers having an alkylamino group such as dimethylaminoethyl vinyl ether, those having sulfonic acid group such as vinylsulfonic acid, styrenesulfonic acid and a salt thereof, 2-acryloylamino-2-methylpropanesulfonic acid and a salt thereof, vinylpyrrolidone, and so forth.

As the monomers having a polymerizable unsaturated double bond and a hydrophobic group, those having a polymerizable double bond and a lipophilic hydrocarbon group, aromatic ring group or alicyclic group and so forth can be used. Examples include, for example, "alkyl (meth)acrylates such as methyl (meth)acrylate, ethyl (meth)acrylate, n-butyl (meth)acrylate, isobutyl (meth)acrylate, n-hexyl (meth)acrylate, 2-ethylhexyl (meth)acrylate, octyl (meth)acrylate and decyl (meth)acrylate", "glycidyl (meth)acrylate", "aromatic vinyl compounds such as styrene, 2-methylstyrene, vinyltoluene, t-butylstyrene, chlorostyrene, vinylanisole, vinylnaphthalene and divinylbenzene", "vinylidene halides such as vinylidene chloride and vinylidene fluoride", ethylene, propylene, isopropylene, butadiene, vinyl chloride, vinyl ether, vinyl ketone, chloroprene, acrylonitrile, methacrylonitrile, and so forth.

As another means for denaturing a polyester resin, a polyester polyol may be used as the polyester resin, and reacted with a polyisocyanate to form a polyester polyurethane.

By the techniques exemplified above, hydrophilicity of the water-insoluble polyester resin can be controlled, and thereby the contact angle of the catalyst adhering layer surface to purified water can be made to be 60° or smaller.

The aforementioned water-insoluble polyester resin is preferably self-crosslinkable. If a self-crosslinkable polyester resin is used, a plate layer formed by electroless plating and a plate layer formed by subsequent electrolytic plating become crack-resistant, and thus durability of the plate layers can be improved.

A self-crosslinkable polyester resin can be obtained by graft copolymerization of self-crosslinkable monomers having methylol group, glycidyl group or the like. In particular, when a monomer having a polymerizable unsaturated double bond is graft-copolymerized on a polyester resin having polymerizable unsaturated double bond to denature the polyester resin, a self-crosslinkable monomer such as N-methylol (meth)acrylamide and glycidyl (meth)acrylate is used as the monomer having a polymerizable unsaturated double bond. Thereby, hydrophilic groups can be introduced and, at the same time, the polyester resin can be made self-crosslinkable. Since such monomers self-crosslink upon heating, catalyst adhering property and dissolution preventing property of the catalyst adhering layer can be controlled by performing heating according to the stage of the production process. For example, only a part of the resin is crosslinked before adhering the catalyst to save non-crosslinked part, and crosslinking of the saved part of the resin is advanced after adhering the catalyst. With an operation in such a manner, while obtaining favorable adhesion of the catalyst, dissolution of the catalyst adhering layer into the plating bath can be prevented, and insulation property of the catalyst adhering layer can be improved accompanied with the advance of crosslinking.

Moreover, since the hydrophilic monomer such as N-methylol(meth)acrylamide is originally hydrophilic, it shows more favorable catalyst adhering property compared with a hydrophobic monomer even after the self-crosslinking. Therefore, such a monomer can make it easier to obtain the catalyst adhering layer showing superior catalyst adhering property as well as superior dissolution preventing property and insulating property.

The polyester resin preferably has a number average molecular weight of 2,000 to 30,000. With a number average molecular weight of 2,000 or larger, a strong coating can be formed, and with a number average molecular weight of 30,000 or smaller, it can be made easier to prevent generation of curling.

The catalyst adhering layer may contain a resin other than the polyester resin mentioned above. Examples of such a resin include, for example, polyvinylbutyral, acrylic resin, polyurethane resin, and so forth. Although the resin other than the polyester resin may be hydrophilic or hydrophobic, it is preferably water-insoluble, in order to prevent dissolution. The contact angle of the catalyst adhering layer surface to purified water can also be controlled with such other resins. Even when the other resin is contained, the polyester resin mentioned above is preferably contained in an amount of 50% by weight or more, more preferably 80% by weight or more, still more preferably 90% by weight or more, based on the total resin constituting the catalyst adhering layer.

Although thickness of the catalyst adhering layer cannot be generally defined, since it may vary depending on types of monomers constituting the polyester resin and so forth, it is preferably 0.05 to 3 μm, more preferably 0.05 to 0.5 μm. With a thickness of 0.05 μm or larger, it can be made easier to adhere the catalyst, and with a thickness of 3 μm or smaller, it is possible to prevent delamination of the catalyst adhering layer due to invasion of a developer from the side at the time of the pattern formation mentioned later and degradation of insulating property of the catalyst adhering layer. Further, with a thickness of 0.5 μm or smaller, the electroless plate and electrolytic plate formed on the catalyst adhering layer can be made crack resistant.

The catalyst adhering layer can be formed by applying a coating solution dissolving materials constituting the layer such as the resin in an appropriate solvent on the non-conductive base material by a known coating method such as bar coating, and drying the solution, molding of the non-conductive base material and the catalyst adhering layer by co-extrusion of the materials constituting them, or the like. The catalyst adhering layer does not need to be formed over the whole surface of the non-conductive base material, and it may be formed over a part of it. By providing the catalyst adhering layer over a part of the non-conductive base material, the catalyst can be selectively adhered to the part of the non-conductive base material, and thus the electroless plating and electrolytic plating can be selectively performed on that part.

The coating solution for forming the catalyst adhering layer, explained above as an element of the material for forming electroless plate of the present invention, may be a coating solution for adhering catalyst for adhering a catalyst for electroless plating by applying it to an arbitrary material to be plated. By applying this coating solution for adhering catalyst on an arbitrary material to be plated consisting of a material similar to that of the non-conductive base material mentioned above, or immersing the material to be plated in the coating solution for adhering catalyst, the catalyst adhering layer is formed to produce the material for forming electroless plate.

As described above, the catalyst adhering layer of the material for forming electroless plate of the present invention contains a water-insoluble polyester resin and surface thereof shows a contact angle of 60° or smaller to purified water. Therefore, it shows favorable catalyst adhering property, no delamination of the catalyst adhering layer from the non-conductive base material, no dissolution of the catalyst adhering layer into a plating solution or a catalyst solution, and no discoloration of plate layer.

In particular, by using a self-crosslinkable polyester resin, dissolution of the catalyst adhering layer into an electroless plating bath or an electrolytic plating bath can be prevented with maintaining favorable catalyst adhering property thereof, and formed electroless plate layer and plate layer can be made more crack resistant.

Hereafter, the method for forming an electroless plate of the present invention will be explained. The method for forming an electroless plate of the present invention is characterized by adhering a catalyst to the catalyst adhering layer of the material for forming electroless plate of the present invention, and then performing electroless plating. Embodiments of the method for forming an electroless plate of the present invention will be explained below.

First, a catalyst is adhered to the catalyst adhering layer of the material for forming electroless plate of the present invention described above.

As the fine metal particles having a catalytic activity for electroless plating (catalyst), those of gold, silver, ruthenium, rhodium, palladium, tin, iridium, osmium, platinum and so forth and mixtures thereof can be used. The catalyst is preferably used as a colloidal solution. Generally used as the method for the preparation of colloidal solution of the catalyst is a method of dissolving a water-soluble salt containing the catalyst in water, adding a surfactant to the solution, and adding a reducing agent to the mixture with vigorous stirring. However, other known methods may also be used.

Examples of the method for adhering the catalyst to the catalyst adhering layer of the material for forming electroless plate include a method of successively performing a sensitization treatment (sensitizing) and an activation treatment (activating) by using a colloidal solution of the catalyst, and a method of successively performing catalyzing and accelerating. According to the present invention, since the catalyst adhering layer surface shows a contact angle to purified water in a specific range, and the catalyst adhering layer shows superior catalyst adhering property, the catalyst adhesion step can be completed in an extremely short period of time, and thereby dissolution of the catalyst adhering layer into the catalyst solution can be prevented.

It is preferable to subject the material for forming electroless plate to a degreasing treatment which is performed by washing with an acid and/or alkali before the catalyst is adhered to the catalyst adhering layer. According to the present invention, since the catalyst adhering layer surface shows a contact angle to purified water in a specific range, the degreasing treatment can also be completed in an extremely short period of time.

In general, in addition to the degreasing treatment, conditioning and pre-dipping steps are generally performed before a catalyst is adhered to the catalyst adhering layer. However, those steps may be omitted according to the present invention, because the catalyst adhering layer surface shows a contact angle to purified water in a specific range.

After the catalyst is adhered to the catalyst adhering layer, electroless plating is performed. The electroless plating can be performed by, for example, immersing the material for forming electroless plate, on which the catalyst is adhered, in an electroless plating bath containing a water-soluble compound of a metal to be plated (usually metal salt), a complexing agent, a pH adjustor, a reducing agent and a plating aid. By adjusting various conditions such as bath composition, temperature, pH and immersion time, thickness of the electroless plate can be controlled.

Examples of the metal to be plated by the electroless plating including non-electrolytic copper, non-electrolytic nickel, non-electrolytic copper/nickel/phosphorus alloy, non-electrolytic nickel/phosphorus alloy, non-electrolytic nickel/boron alloy, non-electrolytic cobalt/phosphorus alloy, non-electrolytic gold, non-electrolytic silver, non-electrolytic palladium, non-electrolytic tin and so forth.

As the complexing agent, pH adjustor, plating aid and reducing agent, those conventionally known as these can be used.

After an electroless plate is formed, electrolytic plating is performed as required. The electrolytic plating can be performed by immersing the material for forming electroless plate on which electroless plate is formed in a known electrolytic plating bath and electrifying it. By adjusting current density and electrification time, thickness of the electrolytic plate can be controlled.

After the electrolytic plate is formed, pattern formation may be performed as required. The pattern formation can be performed by, for example, applying a photoresist to the electrolytic plate, performing exposure and removing the photoresist of exposed or unexposed portions with a developer together with the electrolytic plate, the electroless plate and the catalyst adhering layer.

The material for forming electroless plate on which electroless plate or electroless plate and electrolytic plate are formed as described above can be used for printed wiring boards, electromagnetic wave shielding members, sheet type heating elements, antistatic sheets, antennas, and so forth.

EXAMPLES

Hereafter, the present invention will be further explained with reference to examples. The term "part" and the symbol "%" are used on the weight basis, unless specifically indicated.

Example 1

On one surface of a polyester film having a thickness of 100 μm (Lumirror T60, Toray Industries, Inc.), a coating solution for catalyst adhering layer, which was prepared by diluting a water-insoluble polyester resin (Pesresin wac-15x, Takamatsu Oil & Fat Co., Ltd., self-crosslinkable resin) with a solvent, was applied and dried to form a catalyst adhering layer having a thickness of 1 μm, and thereby obtain a material for forming electroless plate of Example 1.

Example 2

A material for forming electroless plate of Example 2 was obtained in the same manner as that of Example 1 except that the water-insoluble polyester resin of Example 1 was changed to another water-insoluble polyester resin (Pesresin wac-17xc, Takamatsu Oil & Fat Co., Ltd., self-crosslinkable resin).

Example 3

A material for forming electroless plate of Example 3 was obtained in the same manner as that of Example 1 except that the water-insoluble polyester resin of Example 1 was changed to another water-insoluble polyester resin (PLAS COAT Z-850, Goo Chemical Co., Ltd.).

Example 4

A material for forming electroless plate of Example 4 was obtained in the same manner as that of Example 1 except that the water-insoluble polyester resin of Example 1 was changed to another water-insoluble polyester resin (PLAS COAT Z-730, Goo Chemical Co., Ltd.).

Example 5

A material for forming electroless plate of Example 5 was obtained in the same manner as that of Example 1 except that the water-insoluble polyester resin of Example 1 was changed to another water-insoluble polyester resin (PLAS COAT RZ-570, Goo Chemical Co., Ltd.).

Comparative Example 1

A material for forming electroless plate of Comparative Example 1 was obtained by subjecting a polyester film having a thickness of 100 μm (Lumirror T60, Toray Industries, Inc.) to a corona discharge treatment.

Comparative Example 2

A material for forming electroless plate of Comparative Example 2 was obtained in the same manner as that of Example 1 except that the water-insoluble polyester resin of Example 1 was changed to another water-insoluble polyester resin (Vylon 200, Toyobo Co., Ltd.).

Comparative Example 3

A material for forming electroless plate of Comparative Example 3 was obtained in the same manner as that of Example 1 except that the water-insoluble polyester resin of Example 1 was changed to another water-insoluble polyester resin (Elitel UE3200, Unitika Ltd.).

Comparative Example 4

A material for forming electroless plate of Comparative Example 4 was obtained in the same manner as that of Example 1 except that the water-insoluble polyester resin of Example 1 was changed to a water-soluble polyester resin (Pesresin A-10, Takamatsu Oil & Fat Co., Ltd.).

Comparative Example 5

On one surface of a polyester film having a thickness of 100 μm (Lumirror T60, Toray Industries, Inc.), a coating solution for curable layer having the following composition was applied and dried at 100° C. for 30 seconds to form a curable layer having a thickness of 1 μm. Immediately after the formation of the curable layer, a coating solution for catalyst adhering layer having the following composition was applied on the curable layer and dried at 110° C. for 5 minutes to form a catalyst adhering layer having a thickness of 1.5 μm and thereby obtain a material for forming electroless plate of Comparative Example 5.

| <Coating solution for curable layer> | |
|---|---|
| Polyester resin (Vylon 200, Toyobo Co., Ltd., solid content: 100%) | 10 parts |
| Isocyanate compound (Takenate D160N, Mitsui Chemicals Polyurethane Inc.) | 1 part |
| Methyl ethyl ketone | 40 parts |
| Toluene | 40 parts |
| Cyclohexanone | 10 parts |

| <Coating solution for catalyst adhering layer> | |
|---|---|
| Polyvinyl alcohol (Gohsenol NH2O, Nippon Synthetic Chemical Industry Co., Ltd.) | 1 part |
| Water | 9 parts |

Comparative Example 6

A material for forming electroless plate of Comparative Example 6 was obtained in the same manner as that of Comparative Example 5 except that the polyester resin contained in the coating solution for curable layer of Comparative Example 5 was changed to another polyester resin (Elitel UE3350, Unitika, Ltd., solid content: 100%), and the amount of the isocyanate compound was changed to 14 parts.

The following steps (1) to (4) were performed for the materials for forming electroless plate of Examples 1 to 5 and Comparative Examples 1 to 6 to form an electroless plate and an electrolytic plate on the catalyst adhering layer of each material for forming electroless plate.

(1) Degreasing Treatment

A degreasing treatment was performed for 60 seconds by using an aqueous alkaline solution.

(2) Adhesion of Catalyst

A sensitization treatment and an activation treatment were successively performed for 60 seconds and 30 seconds, respectively, by using a mixed colloidal solution of palladium and tin as a catalyst bath.

(3) Electroless Plating

Electroless plating was performed by using an electroless plating bath having the following composition under conditions of a bath temperature of 60° C. and an immersion time of 15 minutes.

| <Electroless plating bath> | |
|---|---|
| Copper sulfate pentahydrate | 0.03 M |
| EDTA tetrahydrate | 0.24 M |
| Formalin | 0.20 M |
| Dipyridyl | 10 ppm |
| Surfactant | 100 ppm |

(4) Electrolytic Plating

Electrolytic plating was performed by using a copper sulfate plating bath (CU-BRITE TH Process, Ebara Udylite Co., Ltd.) as an electrolytic plating bath until the plate thickness became about 30 μm.

The materials for forming electroless plate of Examples 1 to 5 and Comparative Examples 1 to 6 on which electroless plate and electrolytic plate were formed were evaluated for the following items. The results are shown in Table 1. Contact angles to purified water of the catalyst adhering layer surfaces of the materials for forming electroless plate of Examples 1 to 5 and Comparative Examples 1 to 6 are also shown in Table 1.

(1) Uniformity of Plate

Whether the plate was uniformly formed or not was evaluated by visual inspection. The results that plate was uniformly formed without unevenness are indicated with "○", and the results that plate showed unevenness and was not uniformly formed are indicated with "X".

(2) Adhesion

Each plated surface was cut so that 100 grids should be formed with 1 mm-gaps between them, cellophane adhesive tape was stuck on a cut part of the surface and removed, and then ratio of area where the layers (electrolytic plate, electroless plate, catalyst adhering layer, curable layer) still adhered to the non-conductive base material was evaluated by visual inspection.

(3) Dissolution Preventing Property

Each material was immersed in purified water for 10 minutes, then taken out and sufficiently dried, and weight change of the material relative to that observed before the immersion was measured. The results of no weight change, namely, no dissolution of the catalyst adhering layer, are indicated with "○", and the results of dissolution of 20% by weight or more of the catalyst adhering layer are indicated with "X".

(4) Discoloration of Plate Layer

Color of the plate layer was observed from the base material side immediately after the electroless plating was performed. The results of clear copper color of the plate layer are indicated with "○", and the results of blackened color are indicated with "X",

TABLE 1

| | Contact angle | Uniformity | Adhesion | Dissolution preventing property | Dis-coloration |
|---|---|---|---|---|---|
| Example 1 | 35° | ○ | 100% | ○ | ○ |
| Example 2 | 35° | ○ | 100% | ○ | ○ |
| Example 3 | 40° | ○ | 100% | ○ | ○ |
| Example 4 | 40° | ○ | 100% | ○ | ○ |
| Example 5 | 52° | ○ | 95% | ○ | ○ |
| Comparative Example 1 | 20° | X | 0% | ○ | ○ |
| Comparative Example 2 | 65° | X | 0% | ○ | ○ |
| Comparative Example 3 | 65° | X | 0% | ○ | ○ |
| Comparative Example 4 | 40° | ○ | 100% | X | ○ |
| Comparative Example 5 | 40° | ○ | 100% | ○ | X |
| Comparative Example 6 | 40° | ○ | 100% | ○ | X |

Since the catalyst adhering layers of the materials for forming electroless plate of Examples 1 to 5 contained a water-insoluble polyester resin, and the catalyst adhering layer surfaces thereof showed a contact angle smaller than 60° to purified water, these materials showed superior catalyst adhering property ("Uniformity" and "Adhesion" of the aforementioned results), and superior dissolution preventing property of the catalyst adhering layer, and they also showed no discoloration of the plate layers at the interfaces with the catalyst adhering layers.

On the other hand, although the catalyst adhering layer surface of the material for forming electroless plate of Comparative Example 1 showed a contact angle smaller than 60° to purified water, it did not have catalyst adhering layer, and therefore it showed poor catalyst adhering property ("Uniformity" and "Adhesion" of the aforementioned results).

Although the materials for forming electroless plate of Comparative Examples 2 and 3 had a catalyst adhering layer containing a water-insoluble polyester resin, the catalyst adhering layer surfaces thereof showed a contact angle exceeding 60° to purified water, and therefore they showed poor catalyst adhering property ("Uniformity" and "Adhesion" of the aforementioned results).

Although the material for forming electroless plate of Comparative Example 4 had a catalyst adhering layer containing a polyester resin, the polyester resin was a water-soluble resin, and therefore it showed poor dissolution preventing property of the catalyst adhering layer.

Although the materials for forming electroless plate of Comparative Examples 5 and 6 had a catalyst adhering layer, and the catalyst adhering layer surfaces thereof showed a contact angle smaller than 60° to purified water, the catalyst adhering layers did not contain water-insoluble polyester resin, and therefore interfaces of the plate layers with the catalyst adhering layers were blackened.

The materials for forming electroless plate of Examples 1 to 5 were further evaluated for cracking of the formed plate layers.

(5) Evaluation of Cracking of Plate

Each of the materials for forming electroless plate of Examples 1 to 5 was additionally heated at 130° C. for 5 minutes after the electroless plate was formed, then electrolytic plate was formed, and cracking of the electrolytic plated surface was observed. In the materials for forming electroless plate of Examples 1 and 2, self-crosslinking advanced due to the additional heat treatment, and they showed substantially no crack, and thus superiority of these materials was demonstrated over the materials for forming electroless plate of Examples 3 to 5 in which self-crosslinking did not occur.

The materials for forming electroless plate of Examples 1 to 5 were prepared again with changing the thickness of the catalyst adhering layer (1.0 μm) to 0.7, 0.5, 0.2 and 0.05 μm, and cracking of the electrolytic plate surfaces was observed. As a result, it was confirmed that the surface of the catalyst adhering layer became more resistant to cracking as the catalyst adhering layer became thinner.

The invention claimed is:

1. A material for forming electroless plate comprising a non-conductive base material, a catalyst adhering layer provided on the non-conductive base material, wherein the catalyst adhering layer is free of catalyst and comprises a water-insoluble polyester resin, wherein a surface of the catalyst adhering layer, opposite the non-conductive base material, shows a contact angle of 60° or smaller to purified water, and a particulate metal catalyst adhered to the surface of the catalytic adhering layer, wherein the water-insoluble polyester resin is a self-crosslinkable polyester resin.

2. The material for forming electroless plate according to claim 1, wherein the catalyst adhering layer contains the polyester resin in an amount of 50% by weight or more of the total resin constituting the catalyst adhering layer.

3. The material for forming electroless plate according to claim 1 wherein the water-insoluble polyester resin has a hydroxyl value of 10-400 mg KOH/g.

4. The material for forming electroless plate according to claim 3, wherein the catalyst adhering layer contains the polyester resin in an amount of 50% by weight or more of the total resin constituting the catalyst adhering layer.

* * * * *